US007056132B1

(12) United States Patent
Berglund et al.

(10) Patent No.: US 7,056,132 B1
(45) Date of Patent: Jun. 6, 2006

(54) POWER TERMINAL AND A UNIT COMPRISING SUCH POWER TERMINAL

(75) Inventors: Jan Anders Berglund, Järfälla (SE); Ulf Bengt Ingemar Karlsson, Bagarmossen (SE)

(73) Assignee: Danaher Motion Stockholm AB, Stockholm (SE)

( * ) Notice: Subject to any disclaimer, the term of this patent is extended or adjusted under 35 U.S.C. 154(b) by 20 days.

(21) Appl. No.: 11/022,833

(22) Filed: Dec. 28, 2004

(51) Int. Cl.
*H01R 12/00* (2006.01)

(52) U.S. Cl. ..... 439/76.1; 439/801

(58) Field of Classification Search ..... 439/76.1, 439/78–83, 92, 95, 801, 913, 721, 731, 709, 439/886, 883
See application file for complete search history.

(56) References Cited

U.S. PATENT DOCUMENTS 4,273,408 A * 6/1981 Orr ..... 439/737
4,650,274 A * 3/1987 Schmid ..... 439/801
4,790,764 A * 12/1988 Kawaguchi et al. ..... 439/78
5,439,398 A * 8/1995 Testa et al. ..... 439/801
6,280,263 B1 * 8/2001 Manor et al. ..... 439/801
6,358,099 B1 * 3/2002 Kolody et al. ..... 439/716
6,361,382 B1 * 3/2002 Yamada et al. ..... 439/813
6,461,172 B1 * 10/2002 Ross ..... 439/78
6,679,708 B1 * 1/2004 Depp et al. ..... 439/76.2

* cited by examiner

*Primary Examiner*—Alexander Gilman
(74) *Attorney, Agent, or Firm*—Sughrue Mion, PLLC

(57) ABSTRACT

A power terminal for electrical connection of an electric cable to a circuit board comprises a main body (8*a*) having a central longitudinal axis and means (12, 12*a*) for attaching a cable to the main body. An eccentric body (8*b*) integral with the main body (8*a*) and having a through hole (13) is arranged to receive a screw. A space (20) is provided at the bottom of the power terminal adjacent to the eccentric body. This configuration provides a means for securing the terminal in an easy and efficient way while also providing for mounting of a current measuring device, for example.

13 Claims, 4 Drawing Sheets

POWER TERMINAL AND A UNIT COMPRISING SUCH POWER TERMINAL

FIELD OF INVENTION

The present invention relates generally to power terminals and more particularly to a power terminal, particularly for electrical connection of an electric cable to a circuit board, which is easy to mount, flexible in new designs and which makes efficient use of circuit board area. A unit comprising such a power terminal is also provided.

BACKGROUND

Power terminals are used on devices such as drive units for electric motors. A conventional power terminal tower in a drive unit is often split in two halves where one goes up to the cover and one goes down to the power board and the halves are not on top of each other. Since the electrical signal in the terminal is used on both a control board and a power board both halves are mounted to the control board, which takes up a lot of space on the board, or one of the halves is placed outside of the board and is connected via a bus bar (normally a copper plate) which gives a more expensive solution and a bigger drive. Both solutions give a complicated assembly with many screws, often in inconvenient directions, and they also make the cooling of the terminal worse because of the high thermal resistance to the heat sink. Furthermore these solutions make the cover and the control board tightly tied together and the terminal position cannot be moved on the cover without modifying the one on the control board and vice versa.

Instead of terminals with circular cross-sections some designs use flat plates (bus bars) to take the signals from the outside of the cover and into the boards. One problem here is to achieve a good sealing through the cover combined with robustness and ease of assembly. The use of flat plates often require soldering fixtures in production to keep the bus bars upright, and there can be soldering problems if the boards are slightly bent. To avoid mechanical forces from the outside going all the way down to the solder joints on the board you may want to insert some bends in the plate, but bends are costly because they are often made manually.

Sealing of the area between the power terminal and the cover of the drive unit is important in order to prevent leakage of water etc. into the drive unit. One way of achieving a good sealing is to use O-rings. However, O-ring gaskets that are not rolling often have to be lubricated when mounted into the cover. That is an extra cost and also an extra risk that the lubricant, which often contains oil is misplaced on the surface where the cable shoe is pressed to the terminal with the risk of a bad electrical connection.

Also, gaskets that are not rolling cannot be compressed that much because of the risk that they will get stuck, and they therefore have to be made of harder rubber that demands tighter tolerances on terminal and cover. With a softer rubber gasket the demands on the cover and board tolerances and strength decrease.

When the gasket is rolling there is no need for a groove on the top part of the power terminal, and without that groove the terminal can be die cast with a much simpler casting tool (no slides). The draft on the top of the terminal and the cover has to be there anyway for the cast and molding process. The groove also leaves a parting line from the casting process that has to be removed in order to maintain a good sealing.

SUMMARY OF THE INVENTION

An object of the present invention is to provide a power terminal which is easy to mount, flexible in new designs and which makes efficient use of circuit board area.

Another object is to provide a power terminal which provides efficient cooling.

Yet another object is to provide a power terminal which is cheap and easy to cast and surface treat.

A further object is to provide a power terminal with low demands on surrounding tolerances combined with good water protection.

The invention is based on the realization that a crank shaped power terminal having a main body and an eccentric body integral thereto, wherein a space is provided at the bottom of the power terminal adjacent to the eccentric body, provides a means for securing the terminal in an easy and efficient way while also providing for mounting of a current measurement device.

According to the invention there is provided a power terminal as defined in appended claim 1.

There is also provided a unit comprising a power terminal according to the invention.

Thus there is provided a power terminal having a general crank shape providing for a space wherein a component, such as a current measuring device can be provided.

In a preferred embodiment, a means for maintaining a lateral position comprises a pin for positioning in a hole in the circuit board.

Further preferred embodiments are defined by the dependent claims.

BRIEF DESCRIPTION OF DRAWINGS

The invention is now described, by way of example, with reference to the accompanying drawings, in which.

DETAILED DESCRIPTION OF THE INVENTION

In the following a detailed description of preferred embodiments of the present invention will be given.

Figure 1:
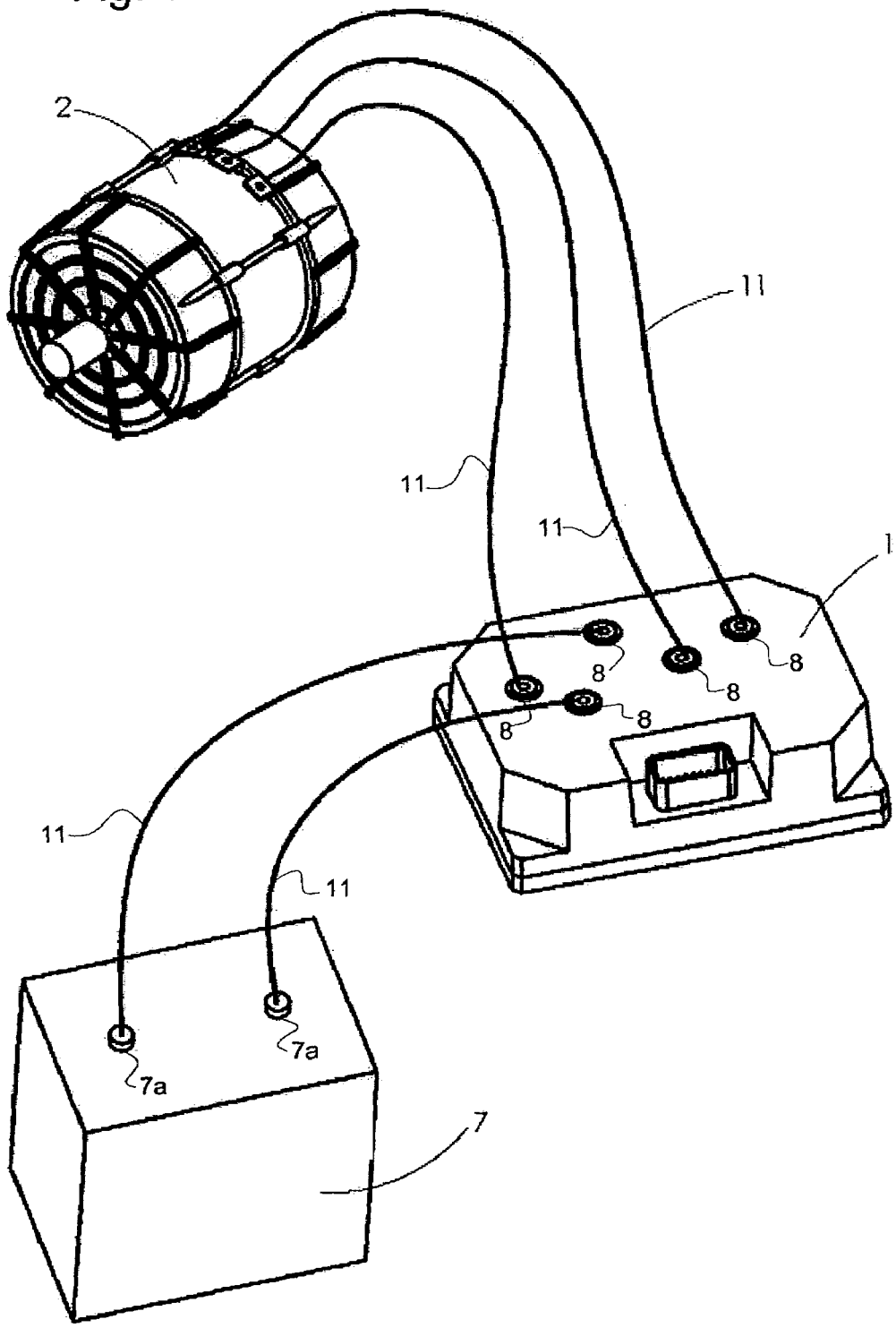
FIG. 1 is an overall view of an arrangement including a battery, an electric motor, and a drive unit according to the invention for controlling the operation of the motor.

In FIG. 1, an overall view of a drive arrangement is shown. This arrangement includes a drive unit 1 connected to a battery 7 by means of two cables 11 connected to terminals 8, 7*a* on the drive unit and the battery, respectively. The drive unit is adapted for power control of an electric motor 2 and is connected thereto by means of three cables 11. These cables are, like the battery cables, connected to a respective power terminal 8 on the drive unit.

Figure 2:
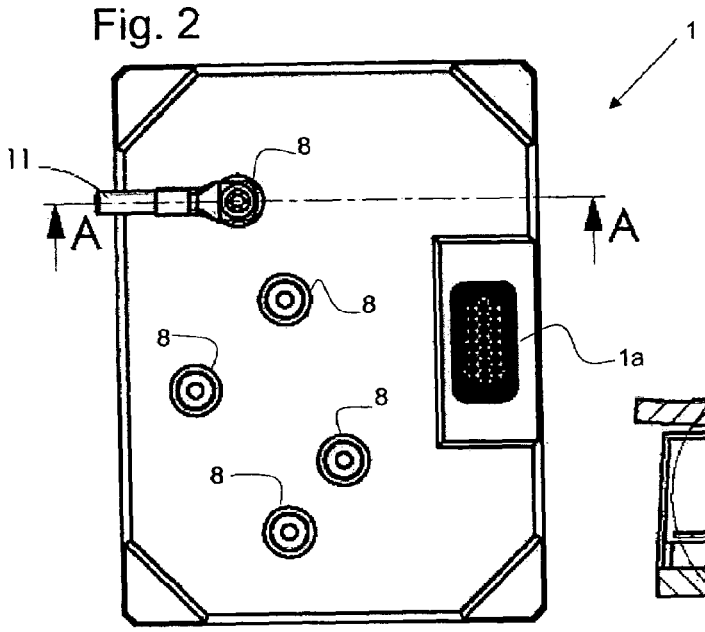
FIG. 2 is a detailed plan view of the drive unit shown in FIG. 1.

The power terminals appear more clearly in the plan view of FIG. 2. The cables 11, one of which is shown in FIG. 2, are attached to the power terminals 8 by means of a screw arrangement, as will be described in detail below. The drive unit 1 also has a pin connector 1*a* used for connecting the drive unit to a control computer, for example.

Figure 3:
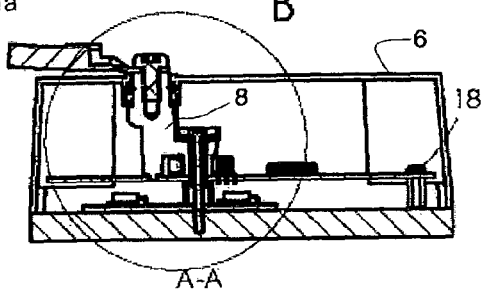
FIG. 3 is a cross-sectional view of the drive unit showing a power terminal according to the invention.

The interior of the drive unit 1 for power control of an electric motor will now be described in detail with reference to FIGS. 3 and 4. The interior is enclosed by a plastic cover 6. Inside the cover there are provided two mutually parallel circuit boards: a control board 3 and a power board 4 mounted on a heat sink 5, see FIG. 4. The control board 3 mounts a number of low power components, such as a hall element 23. The power board 4 mounts a number of power components, such as power transistors 4*a*, which operate to distribute power received from the battery 7 to the motor 2 with the help of the power terminals 8.

Each of the power terminals 8, which are essentially cranked shaped and made of an electrically conductive material, comprises a solid body 8*a* which extends vertically between the cover 6 and the control board 3. In the upper end of the body there is provided coaxially a threaded hole 12 adapted for receiving a screw 12*a* used for attaching the cable 11 to the solid body 8*a* of the power terminal. In the lower end thereof, the solid body 8*a* ends in an alignment pin 9 for positioning accuracy in a tight hole 10 in the control board 3. The alignment pin 9 prevents rotation of the terminal, particularly when a cable 11 is connected to the threaded hole 12 from the outside of the unit by means of a three point attachment, as will be explained below.

Since the alignment pin 9 is provided on the opposite side of the threaded hole 12 on top of the body they both can easily be masked when the power terminal is surface treated, wherein a fixture holding the terminal in an electrochemical bath also does the masking job. Without the masking the diameter of the alignment pin would not be stable since the thickness of the metal layers that are added during the surface treatment is not the same all over the terminal and it can also vary from terminal to terminal.

An eccentric portion 8*b* extends from the solid body 8*a* and being integral therewith. This gives the terminal an essentially cranked shaped profile when viewed from the side, see FIG. 6 for example. A through hole 13 extends vertically through the eccentric portion and is adapted to receive a mounting screw 13*a* having a screw head 16. The crank shape of the power terminal makes it easy to mount with only one such mounting screw 13*a* that optionally can be electrically insulated from the body 8*a* and eccentric portion 8*b* by means of a plastic insulator 14. The eccentric portion 8*b* and the plastic insulator 14 have a respective conical surface 15*a*, 15*b* under the screw head 16, see FIG. 5, to enable the use of a flat spring plate washer 17 that bends when the screw is mounted and therefore provides for a good electrical connection. The mounting screw 13*a* is fixed in the same direction as other screws 18 attaching the boards to the heat sink, see FIG. 3, and this makes the mounting screw quick and easy to assemble.

Without a conical surface under the screw head you have to use a more expensive washer (pre bent) that sometimes have to be mounted in the right direction in order to be efficient and hence can be faulty mounted. With a flat spring washer it is easy to modify the force by simply punching it out from a thicker or thinner plate, using the same punching tool.

A current spacer 19 made of an electrically and thermally conductive material is provided between the control board 3 and the power board 4 and is soldered to the power board. Such a current spacer is described in the European patent publication EP 0711107 B1 and functions as a conductor between the control board and the power board. The fact that the power terminal and the current spacer 19 are on top of each other also makes the heat transfer down to the heat sink efficient due to the resulting low thermal resistance between the terminal 8 and the heat sink 5.

Figure 5:
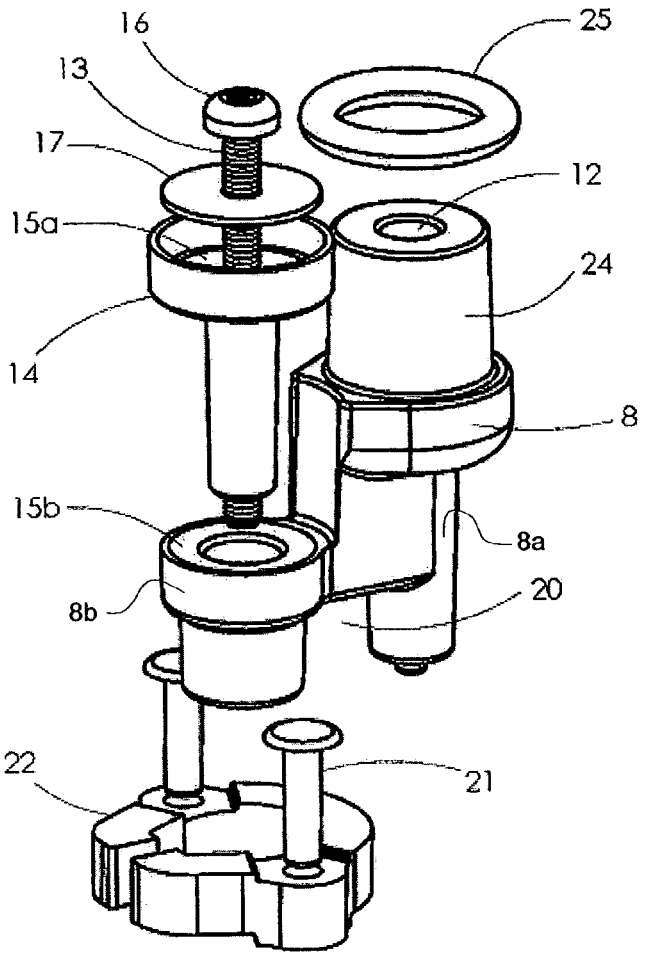
FIG. 5 is an exploded perspective view of the power terminal shown in FIG. 3.

The crank shape also gives room for a space 20 at the bottom of the terminal for a current measurement device 22 mounted with plastic rivets 21, see FIG. 5. The current measurement device comprises an iron core 22 that, together with a hall element 23 are arranged to indirectly measure the current through the terminal by measuring the magnetic field induced in the iron core.

Figure 4:
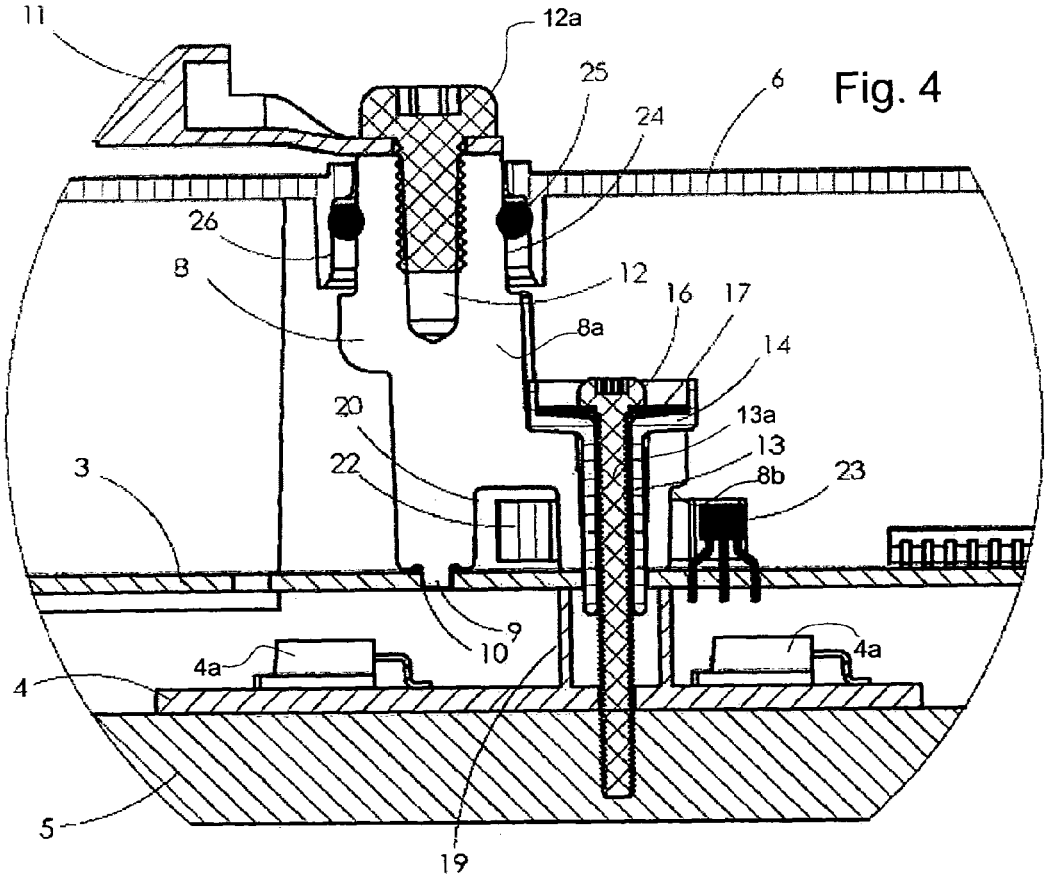
FIG. 4 is a detailed view of the area designated A—A in FIG. 3.
Figure 6:
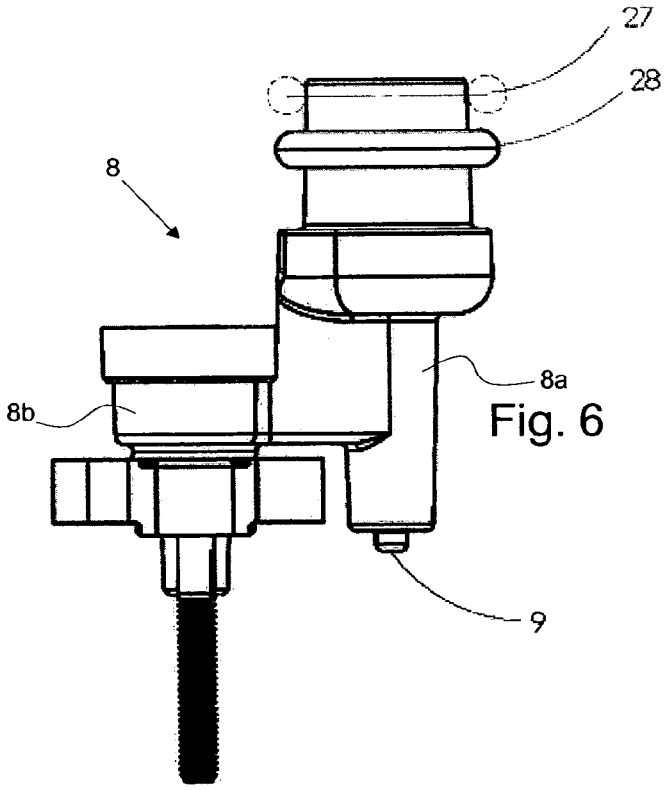
FIG. 6 is a side view of the power terminal shown in FIG. 3.
Figure 7:
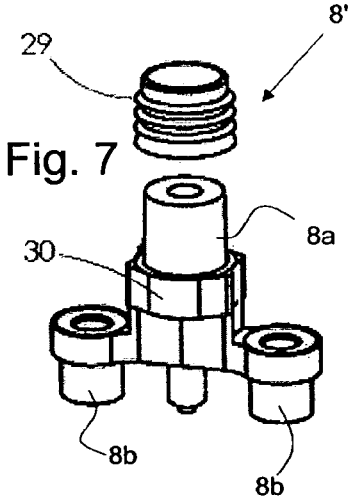
FIG. 7 shows an alternative embodiment of a power terminal according to the invention adapted for high currents.

With reference to FIGS. 4–6, at the top of the body 8*a* there is provided a drafted surface 24 that can be used for a water protection gasket 25 that does not leave any force striving to lift the cover 6 after mounting, but simply pushes the gasket out towards an equally drafted surface 26 on the cover, see FIG. 4. The gasket is rolling from a top position 27 indicated by dashed lines in FIG. 6 down to a mounted position 28 when the cover is mounted and this rolling makes it easy to mount with very low friction. This design also opens up for the use of a special purpose molded multi flange gasket 29, see FIG. 7. The drafted surface preferably has an angle of approximately 1–2°, more preferably 1.5°.

Since the cables connecting the terminals from the outside are relatively thick because of the high currents, such as above 10 Amperes, they need to be connected with big screws, typically M6 or bigger. In the lower part of the terminal on the other hand, too big screws are unwanted because they would take up too much space on the boards. In an alternative embodiment shown in FIG. 7, in the case of very high currents on some of the terminals, a special terminal 8' is provided with more than one eccentric portion 8*b* for a respective mounting screw. In this way, the lower part of the terminal is not the limiting factor for high currents, and you can still use the same kind of screws, washers and insulators.

It can sometimes be of help for the PCB layout to receive the same signal on two different places on the boards, especially on the power board that normally is a single layer PCB. With a multi mounting screw terminal shown in FIG. 7 the alignment pin could be omitted if the demands for position accuracy so admits. The anti rotation is now taken care of by the multiple mounting screws.

When designing new drive units the flexibility of the crank shaped power terminals makes it easier to reuse the same cover for new circuit boards or use the same boards with a new cover by rotating the crank with either the top or the bottom fixed.

When designing new circuit boards (with a reused cover) the power terminals can be rotated with the top fixed. Also, the current measurement iron core 22 can be rotated relative to the power terminal in almost any direction, all this flexibility makes it easier to do the circuit board layout.

In some designs there is just one board serving as both power and control board. In that case the heat sink is simply reshaped by putting in some distances with threaded holes in the middle that replaces the current spacer on the power board and using shorter mounting screws.

In the embodiments described with reference to FIGS. 3–7, an alignment pin 9 is provided to maintain the lateral position of the power terminal in relation to the circuit board. In an alternative embodiment of a power terminal 8" shown in FIG. 8, the alignment pin is omitted. Instead, a lower surface 9' of the main body 8*a* is arranged to provide friction between the main body and the circuit board. Particularly in smaller terminals, this friction, together with the mounting screw 13*a*, is sufficient to prevent rotation of the terminal. The lower surface 9' can be rough so as to increase the friction between the surface and the circuit board. Alternatively, the surface can be provided with adhesive or glue to increase the friction.

Figure 9:
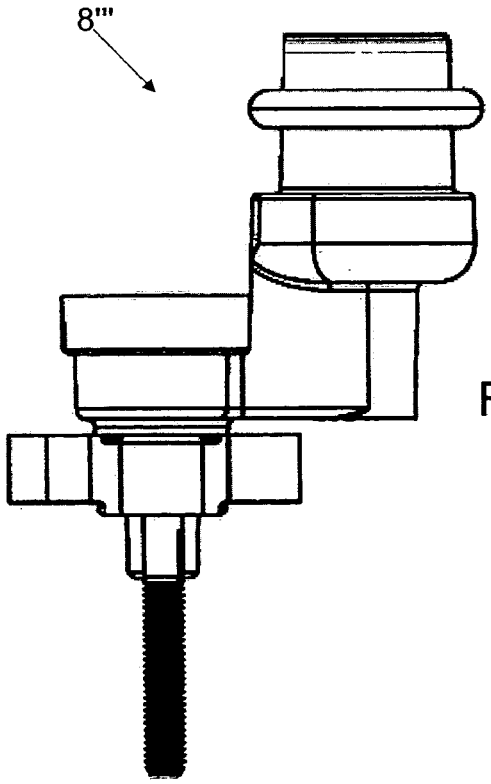

In FIG. 9, yet an alternative embodiment of a terminal according to the invention is shown. In this embodiment, the space adjacent to the eccentric body extends below the main body. This gives further space for components mounted on the circuit board.

Figure 8:
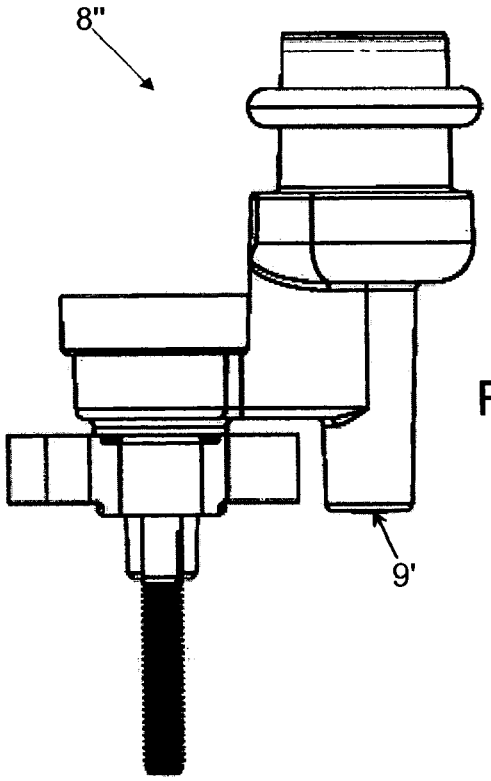
FIGS. 8 and 9 show further alternative embodiments of a power terminal according to the invention.

In the embodiments shown in FIGS. 8 and 9, the clamping force exerted by a screw through the eccentric body may be sufficient to create a friction between the terminal and the circuit board that prevents turning of the terminal in relation to the circuit board.

Preferred embodiments of a power terminal according to the invention and a drive unit comprising such power terminal have been described. A person skilled in the art realizes that this could be varied within the scope of the appended claims.

The inventive power terminal has been described as being electrically connected to a circuit board. It will be appreciated that the term circuit board covers other means for mounting circuits and conducting electricity, such as bus bars etc.

Rolling gaskets 25, 29 have been described as preferred means for water protection. It will be appreciated that such gaskets can be used also together with other kinds of terminals than the described one.

Instead of cables 11, other means, such as bus bars, can be used for connecting to the inventive power terminal.

A drive unit for electrical motors has been described as one kind of unit in which the terminal according to the invention can be used. It will be appreciated that the terminal can be used in other units as well.

The invention claimed is:

1. A power terminal for electrical connection of an electric cable to a circuit board, said terminal comprising:

a main body having a central longitudinal axis;

means for attaching a cable to said main body;

an eccentric body integral with said main body and having a through hole arranged to receive a screw, and an electrical insulator provided in said through hole, wherein a space is provided at the bottom of said power terminal adjacent to said eccentric body.

2. The power terminal according to claim 1, wherein said space provided at the bottom of said power terminal is arranged to receive a current measurement device.

3. The power terminal according to claim 1, wherein said space provided at the bottom of said power terminal is provided between said main body and said eccentric body.

4. The power terminal according to claim 1, wherein a means for maintaining a lateral position of said power terminal in relation to said circuit board comprises a pin on said main body for positioning in a hole in said circuit board.

5. The power terminal according to claim 1, wherein a means for maintaining a lateral position of said power terminal in relation to said circuit board comprises a lower surface of said power terminal providing friction between said power terminal and said circuit board.

6. The power terminal according to claim 1, wherein an upper surface of said eccentric body is conical.

7. The power terminal according to claim 1, comprising an additional eccentric body integral with said main body and having a through hole arranged to receive a screw.

8. The power terminal according to claim 1, wherein said main body has a drafted outer surface.

9. The power terminal according to claim 8, comprising a gasket provided on said outer surface of said main body.

10. A unit comprising a cover and a circuit board, said unit comprising a power terminal provided in a hole through said cover and having a main body with a central longitudinal axis; means for attaching a cable to said main body; an eccentric body integral with said main body and having a through hole; and a screw provided in said through hole connecting said terminal to said circuit board, wherein a space is provided at the bottom of said power terminal adjacent to said eccentric body and said power terminal is mechanically and electrically connected to said circuit board, said unit further comprising an upper and a lower mutually parallel circuit board, wherein said power terminal is mechanically and electrically connected to said upper circuit board, a heat sink provided below said lower circuit board, and a current spacer provided between said upper and lower circuit boards.

11. The unit according to claim 10, wherein a current measurement device is provided on said circuit board in said space of said terminal.

12. The unit according to claim 10, wherein the inner surface of said hole in said cover is drafted for cooperation with a gasket provided on said power terminal.

13. The unit according to claim 12, wherein said gasket is multi-flanged.

* * * * *